US006443443B1

(12) United States Patent
Hirth et al.

(10) Patent No.: US 6,443,443 B1
(45) Date of Patent: Sep. 3, 2002

(54) SUCTION BELT CONVEYER FOR A SHEET PROCESSING MACHINE

(75) Inventors: Roland Hirth, Römerberg (DE); Richard Mack, Kennesaw, GA (US); Udo Lautenklos, Waldmichelbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/536,173

(22) Filed: Mar. 27, 2000

(30) Foreign Application Priority Data

Mar. 26, 1999 (DE) ..... 199 13 704

(51) Int. Cl.[7] ..... B65H 3/12

(52) U.S. Cl. ..... 271/94; 271/231; 271/34; 271/35; 271/10.07; 271/10.08; 226/95; 226/170

(58) Field of Search ..... 271/10.06, 10.07, 271/10.08, 34, 35, 12, 231, 198, 197, 94; 226/95, 170

(56) References Cited

U.S. PATENT DOCUMENTS 3,190,644 A * 6/1965 Schwebel ..... 271/231
3,425,610 A * 2/1969 Stewart ..... 226/95 X
3,477,558 A 11/1969 Fleischauer
4,298,277 A * 11/1981 Silverberg ..... 226/95 X
4,660,752 A * 4/1987 Rikard et al. ..... 226/95
5,595,334 A * 1/1997 Belec et al. ..... 226/95 X
5,706,994 A * 1/1998 Welch et al. ..... 226/95
5,829,740 A 11/1998 Kerpe et al.
5,967,507 A * 10/1999 Moore et al. ..... 271/35 X
6,038,998 A * 3/2000 Platsch
6,056,287 A * 5/2000 Hirth et al. ..... 271/197
6,182,567 B1 * 2/2001 Gunschera et al.

FOREIGN PATENT DOCUMENTS

DE 195 39 663 A1 4/1997
DE 197 12 690 11/1997
DE 197 29 088 A1 1/1999

* cited by examiner

*Primary Examiner*—Christopher P. Ellis
*Assistant Examiner*—Richard Ridley
(74) *Attorney, Agent, or Firm*—Laurence A. Greenberg; Werner H. Stemer; Ralph E. Locher

(57) ABSTRACT

A suction belt conveyor for a sheet processing machine includes an operationally revolving endless suction belt having, at an outer side thereof a filigree structure formed by indentations, the suction belt being formed with penetrating bores terminating in the indentations. In a variation of the foregoing, the suction belt conveyor for a sheet processing machine includes an operationally revolving endless suction belt formed with pores distributed in longitudinal and transverse directions of the suction belt, so that the suction belt is air permeable.

12 Claims, 7 Drawing Sheets

Fig. 6
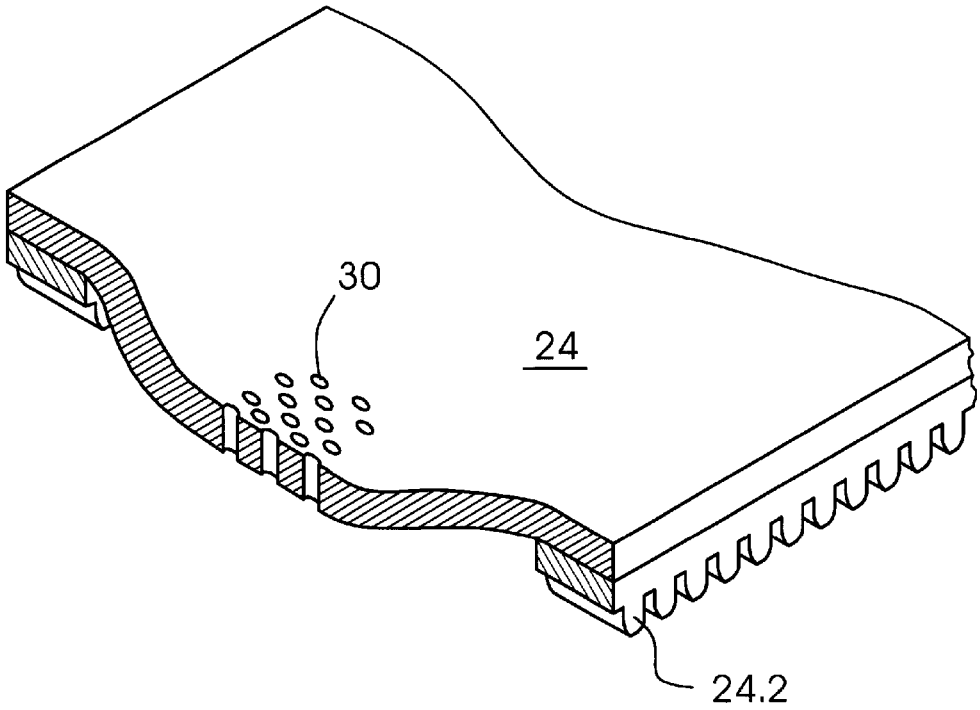
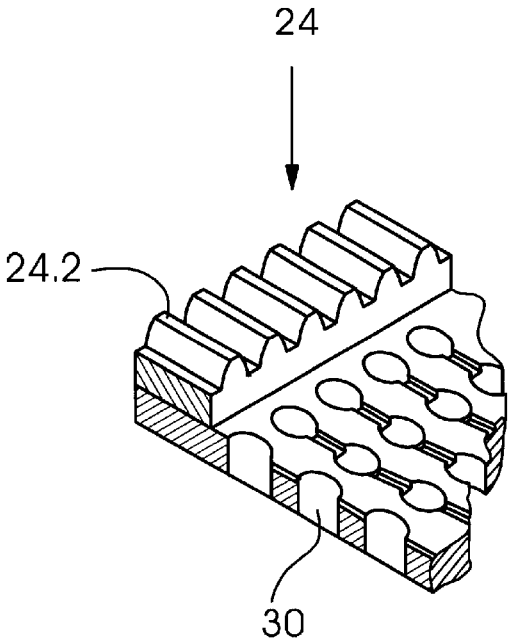
Fig. 7
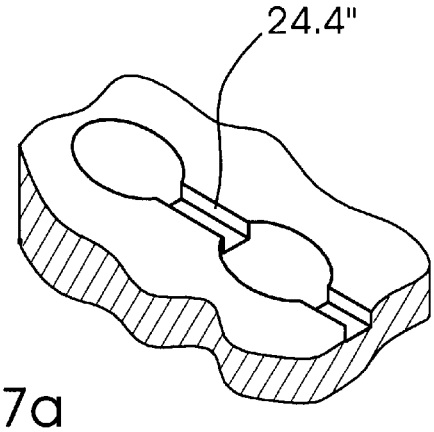
Fig. 7a

SUCTION BELT CONVEYER FOR A SHEET PROCESSING MACHINE

BACKGROUND OF THE INVENTION

Field of the Invention

The invention relates to a suction belt conveyor for a sheet processing machine, particularly a printing machine, with an operationally revolving suction belt as well as a delivery for a sheet processing machine, particularly a printing machine, with a sheet brake formed by suction belt conveyors.

A suction belt conveyor of the foregoing general type and with diverse realizable transport tasks have become known heretofore, for example, from the published German Patent Document DE 197 12 690 A1. A preferred application area is the delay of the stacking or depositing speed of the sheets running through the printing machine to a speed at which the sheets finally encounter stops that assist in forming sheet piles.

For example, in such an application, the suction belt revolves in a manner that each sheet transported to the suction belt is taken up without relative speed with respect to the belt speed, and that the belt subsequently delays the sheet to the depositing or stacking speed. The speed with which the sheets are processable is therefore primarily dependent upon how fast the sheets can be slowed down to the depositing or stacking speed thereof, i.e., high processing speeds require brief sharp delays of the sheets by the suction belt conveyors used for this purpose. Driving the suction belts in such conveyors with corresponding periodically changed speeds is realizable with suitable drive motors, but powerful friction forces must be available between the sheets and the suction belts for transmitting the correspondingly long delays to any of the sheets.

With respect to the most different characteristics of the sheets to be delayed, such as the coarseness or roughness of the sheets to be delayed and the available suitable materials for constructing the suction belt, there are certain limits in the selection of the highest possible coefficient of friction in the pairing of a sheet and a suction belt, so that a strongest possible normal force must exist for creating the high friction forces between the sheet and the suction belt. This requires a highest possible negative pressure or vacuum acting in largest possible suction openings of the suction belt, which can, however, result in markings being formed on the sheets by the rims of the suction openings.

SUMMARY OF THE INVENTION

It is accordingly an object of the invention to provide a suction belt conveyor for a sheet processing machine of the foregoing general type which is constructed so that high friction forces can be transmitted to the sheets and yet the sheets remain as unblemished as possible.

With the foregoing and other objects in view, there is provided, in accordance with one aspect of the invention, a suction belt conveyor for a sheet processing machine, comprising an operationally revolving endless suction belt having, at an outer side thereof a filigree structure formed by indentations, the suction belt being formed with penetrating bores terminating in the indentations.

In accordance with a second aspect of the invention, there is provided a suction belt conveyor for a sheet processing machine, comprising an operationally revolving endless suction belt formed with pores distributed in longitudinal and transverse directions of the suction belt, so that the suction belt is air permeable.

In accordance with another feature of the invention, the suction belt comprises an outer layer and an inner layer.

In accordance with a further feature of the invention, the suction belt has a transport strand and is operationally slidable by an inner side of the transport strand along a support, the transport strand having an outer side for exerting a higher friction force on a transported sheet than the inner side of the transport strand exerts upon the support when a given normal force acts upon the transport strand.

In accordance with an added feature of the invention, the suction belt is formed with parting lines extending substantially crosswise to the longitudinal direction of the suction belt starting from the outer side thereof, the parting lines extending in a direction towards the inner side of the suction belt.

In accordance with an additional feature of the invention, the suction belt conveyor includes a drive wheel, the suction belt having a form locking connection with the drive wheel at least at one edge of the suction belt.

In accordance with yet another feature of the invention, the suction belt, in supplied condition thereof, has a cross section extending in such a manner that an inner side and the outer side of the suction belt have a smaller extension along the longitudinal center thereof than at the edges thereof.

In accordance with a third aspect of the invention, there is provided a delivery of a sheet processing machine, comprising a sheet brake formed by a plurality of suction belt conveyors having at least one of the foregoing features.

In accordance with a concomitant feature of the invention, the sheet processing machine is a printing machine.

Thus, in a first variation of the invention, the suction belt has on the outer side thereof a filigree structure in the form of indentations, and the suction belt is formed with bores terminating in the indentations. In a second variation, the suction belt is formed as an air permeable belt with pores distributed lengthwise and crosswise.

In an advantageous embodiment, the suction belt has an outer layer and an inner layer.

Preferably the outer layer is formed of a material that generates the highest possible friction coefficient in the pairing of sheet and suction belt. In contrast, the inner layer is preferably formed by a material that can slide with as little friction as possible over the support supporting a transport strand formed by the suction belt and effecting the conveyance of the sheets. Such support has become known heretofore, for example, from the published German Patent Document DE 196 49 824 A1; it has at least one suction opening facing the conveyor strand and extends longitudinally along the conveyor strand. A given vacuum can be generated by a negative pressure or vacuum generator to penetrate the suction belt and to press the transmitted sheet by suction against the transport strand at the outer side of the outer layer. The normal force between the respective sheet and the transport strand as well as between the transport strand and the support causes a slight friction between the support and the transport strand due to appropriately selected materials of the inner layer; it also fosters an extension of the life of the suction belt.

The construction of the suction belt formed of individual layers provides also the advantage that the material of the outer layer does not have to be selected with attention to a given tensile strength. Tensile strength is required of the suction belt when it has to be accelerated again after it has released each sheet that has been slowed down to stacking or depositing speed.

This extends the possibilities for forming the outer layer of a material that generates a friction coefficient as high as possible in the pairing of sheet and transport strand.

In such a construction of the suction belt, the cross section height is possibly over-dimensioned with respect to the tensile strength of the suction belt. This is, however, to the benefit of the arrangement of the filigree structure formed by indentations on the outer side of the suction belt.

A further embodiment of the suction belt formed of an outer and an inner layer provides for parting lines or seams extending substantially perpendicularly to the length of the suction belt and starting at this outer side. These parting lines extend to the inner side of the suction belt. This prevents, in a simple manner, the generation of unnecessarily high tensions for the intended purpose of the suction belt; otherwise such tensions can arise when the suction belt is guided tautly over reversing devices. The parting lines also reduce an otherwise higher force for stretching the suction belt and also the corresponding higher inert forces in the event that the suction belt winds around the reversing rolls with pivot bearings.

In addition, at least one marginal edge of the suction belt is preferably formlocked and connected to a drive wheel. The formlocking connection permits an exact coordination of the speed behavior comprising the suction belt delay and acceleration phases to momentary turning positions of, for example, a cylinder carrying one of the sheets within the sheet processing machine.

In a preferred embodiment, the formlocking action connection is formed like a synchronous belt drive, while another preferred embodiment accomplishes the connection with a pin wheel gear. The limitation of the formlocking action connection to at least one of the lateral wheels of the suction belt creates a further advantage insofar as the suction belt can be guided over a support described hereinabove via a width extension at least in a marginal area of the suction belt while it is in complete contact with that support. The support does not support its marginal area. Despite the formlocking action connection especially in the manner of a synchronous belt drive, at least one suction opening of the support does not communicate with the surroundings via tooth gaps in the suction belt. Otherwise this would have the consequence that at least one suction opening of the support would suck inleaked air by reducing the suction effect directed to the sheets due to a given suction force of a negative pressure or vacuum generator connected with the suction opening. Therefore, a negative pressure or vacuum generator with higher suction capacity would be needed for generating a given suction effect. The limitation of the formlocking action connection to at least one of the side edges of the suction belt results, therefore, in a reduction of the otherwise necessary energy consumption.

Another preferred embodiment provides for the new suction belt cross section to extends in a way that the inner side and the outer side of the suction belt are smaller in the center thereof than at the edges thereof.

If a suction belt of this type is wound around reversing devices acting on the side edges, after the side edges are stretched, and if the transport strand is guided over the above support, the suction belt assumes an altered cross section course along the support in a way that the inner surface of the suction belt aligns itself with an elastic deformation to the straight course of the support which runs perpendicularly to the transport strand and slides over the support with a given normal force exerted on the support. The support has a straight support surface and is arranged in a manner that it supports the inner surface of the suction belt up to the vicinity of the side edges. This results in a desired complete contact of the transport strand with the support without any need for an additional stretching of the suction belt as is common with traditional suction belts.

Other features which are considered as characteristic for the invention are set forth in the appended claims.

Although the invention is illustrated and described herein as embodied in a suction belt conveyer for a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 6 is a view similar to that of FIG. 5, showing part of a different embodiment of a continuous suction belt wherein the longitudinal extent of the outer side and of the inner side are shorter in the longitudinal center than in the edge or rim areas;

FIG. 7 is a fragmentary perspective view, partly in section, of the inner side of part of a suction belt that is air permeable due to being formed with pores distributed in the longitudinal and the transverse directions thereof; and FIG. 7*a* is an enlarged fragmentary view of FIG. 7.

DESCRIPTION OF THE PREFERRED EMBODIMENTS

Figure 1:
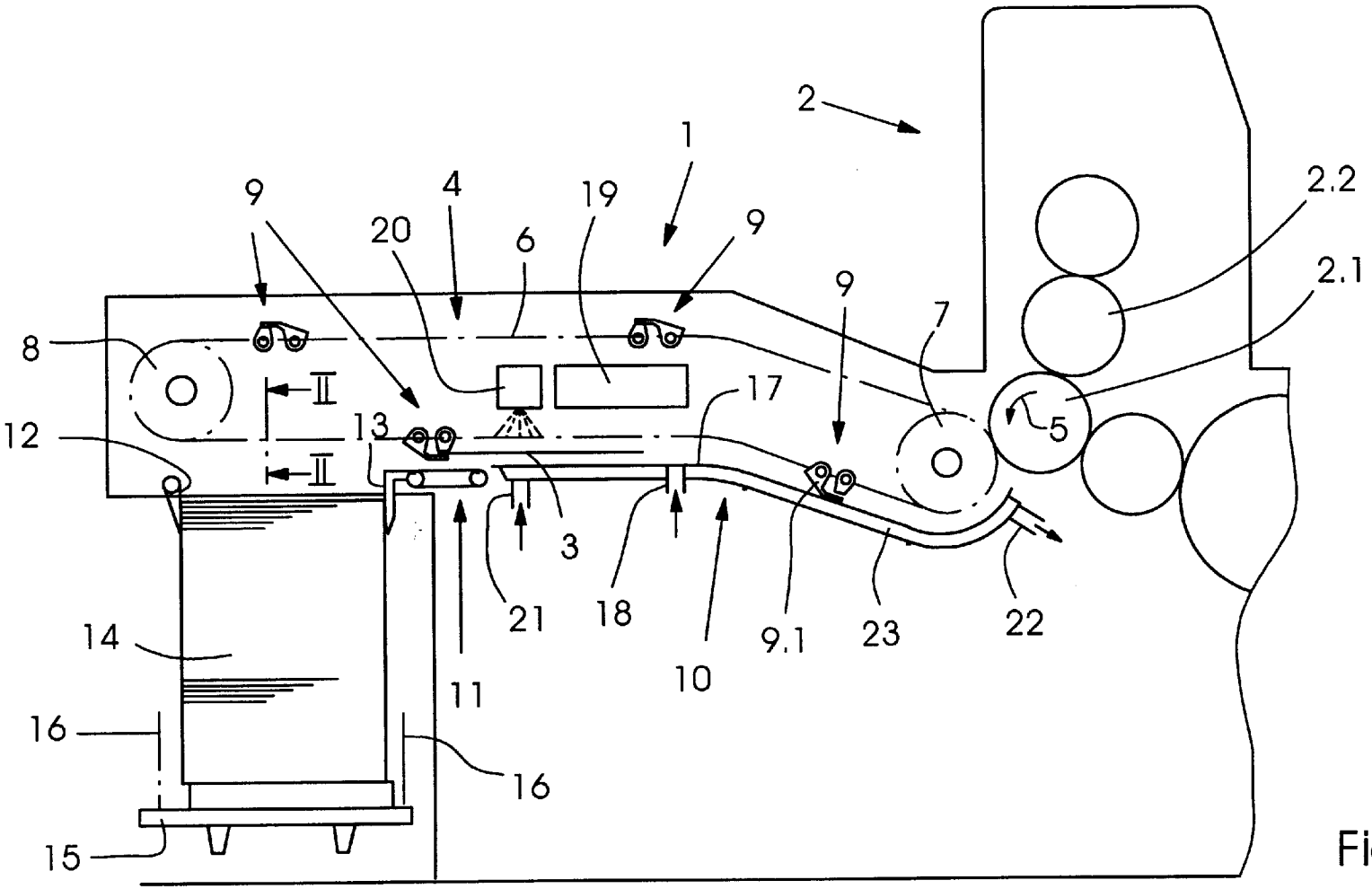
Fig.1 PRIOR ART
FIG. 1 is a fragmentary diagrammatic side elevational view of a sheet processing machine showing a delivery thereof with a sheet brake formed by suction belt conveyors.

Referring now to the drawings and, first, particularly to FIG. 1 thereof, there is shown therein a suction belt conveyor provided for use in a sheet processing machine, especially in a printing machine, that transmits high friction forces preferably intended for retarding the speed of the sheets from a processing speed to a depositing or stacking speed to allow the formation of sheet piles or stacks of the processed sheets.

FIG. 1 illustrates the sheet processing and the subsequent sheet stacking to form a sheet pile with an exemplary sheet processing rotary printing machine. The illustrated section of the printing machine assembly comprises a delivery 1 which follows the last processing station of the printing machine.

Such a processing station can be a printing device or a post-treatment device, such as a varnishing device, for example. In this example, the final processing station is made up of an offset printer 2 with an impression cylinder 2.1. The cylinder guides the sheet 3 in the processing direction (indicated by the arrow 5) through a printing nip between the impression cylinder 2.1 and a cooperating offset blanket cylinder 2.2 and transfers it thereafter to a chain belt conveyor 4 while opening two grippers for gripping the leading end of the sheet 2 at a gripper margin. The conveyor chain 4 comprises two chain belts 6, one of which revolves along a respective side wall of the chain delivery 1. A respective conveyor chain 6 is wound around a respective one of two synchronously driven drive chain wheels 7, the rotary axes of which are in mutual alignment, and in this example is guided over a reversing chain wheel 8 located opposite the drive chain wheels 7, downline with respect to the processing direction. The gripper systems 9 with grippers 9.1 are carried by and extend between the two conveyer chains 6. They drive through gaps between grippers which are disposed on the impression cylinder 2.1 and take over a sheet 3 by gripping the gripper margin at the leading end of the sheet 3 directly prior to the opening of the grippers disposed on the impression cylinder 2.1, and transport it via a sheet guiding device to a sheet brake 11. Then, the grippers open for transferring the sheet 3 to the sheet brake 11. This provides the sheet with a stacking or depositing speed that is lower in comparison with the processing speed, and frees the sheet after that stacking or depositing speed has been attained, so that the then retarded sheet 3 encounters the leading edge or front stops 12 and forms a sheet pile 14 with previous and/or following sheets 3 after they have been aligned at opposite trailing edge or rear stops 13. The sheet pile 14 can be lowered with a piston device the higher the sheet pile 14 grows. FIG. 1 shows only the platform 15 of the piston device carrying the pile 14, and the piston chains 16 shown in phantom carry the platform 15.

The conveyor chains 6 are guided along their path on chain drive tracks located between the drive chain wheels 7, on the one hand, and the reversing chain wheels 8, on the other hand, the tracks determining the chain paths of the chain strands or sides. In this example, the sheets 3 are transported by the lower chain strand shown in FIG. 1. This segment of the chain path is followed alongside by a sheet guiding surface 17 facing towards the chain path and located at the sheet guiding device 10. Between the guiding surface 17 and the sheet 3 passing thereover, an air cushion is provided. For this purpose, the sheet guiding device 10 is provided with blast air jets or nozzles terminating in the sheet guiding surface 17; FIG. 1 shows them together in a symbolic representation in the form of a connection piece 18.

In order to prevent the printed sheets 3 in the pile 14 from sticking together, a dryer 19 and a dusting device 20 are provided on the path of the sheet 3 from the drive chain wheels 7.

To prevent excessive heating of the sheet guiding surface 17 by the dryer 19, a coolant circuit is integrated in the sheet guiding surface 17, and is shown in FIG. 1 in a symbolic representation by an inlet connector 21 and an outlet connector 22 at a coolant tub 23 assigned to the sheet guiding surface 17.

The aforediscussed sheet brake 11 includes a number of brake modules respectively formed by a suction belt conveyor.

Figure 2:
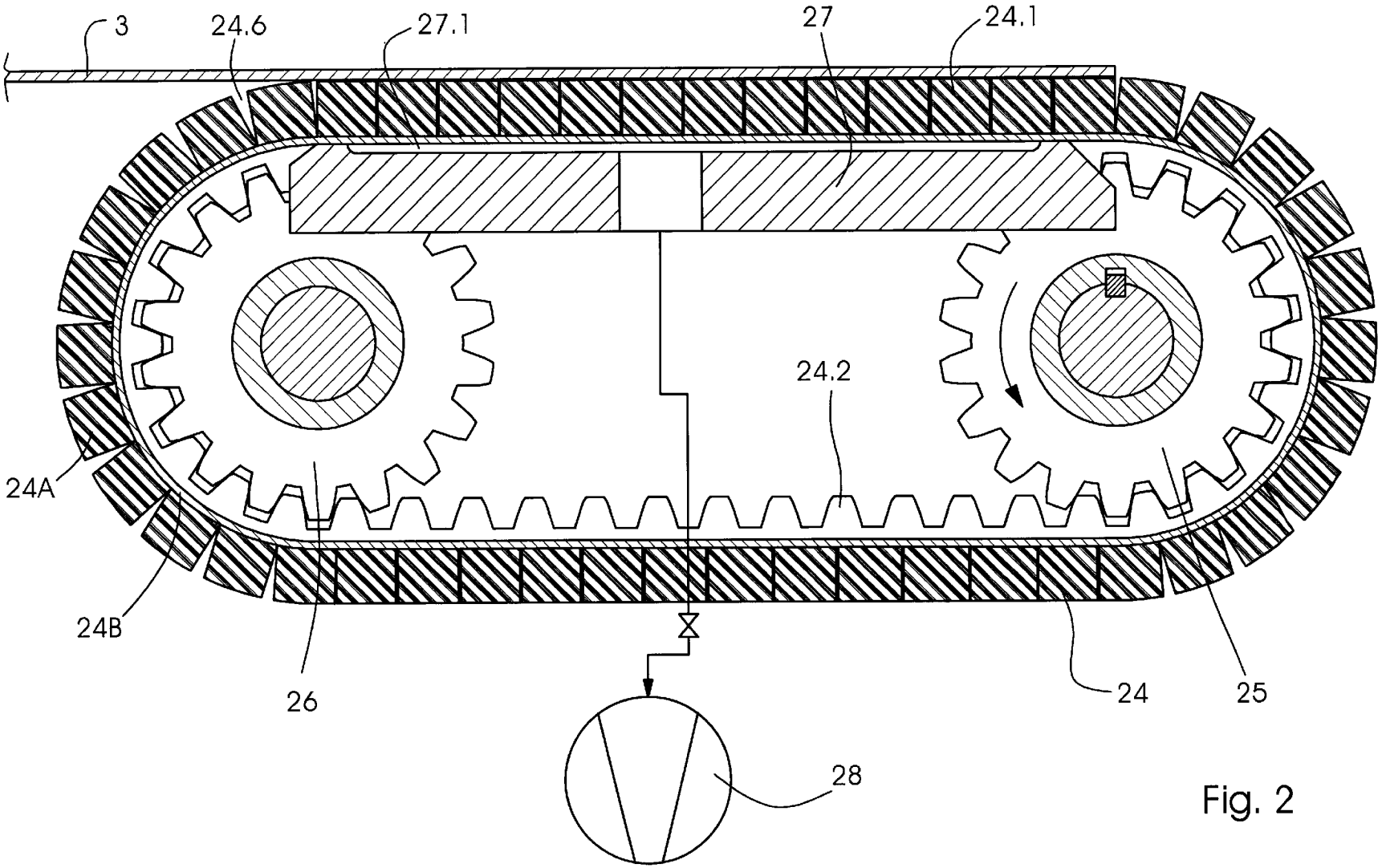
FIG. 2 is a much-enlarged fragmentary longitudinal sectional view of FIG. 1 showing an exemplary embodiment of a suction belt conveyor serving as a sheet brake.

FIG. 2 shows the construction of a suction belt conveyor insofar as it pertains to the function of the conveyor transporting a sheet 3 to the suction belt conveyor. Not shown are the carrying and guiding devices by which the suction belt conveyor intended for braking the sheets 3 is held and is adjustable in different positions in and against conveying direction and horizontally perpendicular thereto.

The suction belt conveyor includes, in particular, an operationally revolving continuous suction belt 24 with a conveyor strand 24.1 contacting each sheet 3. The suction belt 24 is provided with teeth 24.2 at a rim or edge thereof and, in another preferred embodiment, with teeth 24.2 at both rims which, in a stretched state of the suction belt 24 in the longitudinal direction of the suction belt 24, engage with the teeth in the drive rim 25 and the teeth in a reversing gearwheel 26, so that a belt drive interlocks with the suction belt 24 and works together therewith. The means for stretching the suction belt 24 is not shown, in the interest of clarity.

In another non-illustrated embodiment, a formlocking drive of the suction belt proceeds like the advance of a film in a camera. In this case, a reversing wheel without teeth or also a non-rotating reversing area can be provided, resulting in a manufacturing cost efficient embodiment.

A support 27 is attached to the inside of the conveyor strand 24.1. The support 27 has at least one suction opening 27.1 which faces towards the conveyor strand 24.1 and is connected to a negative pressure or vacuum generator 28.

Figure 3:
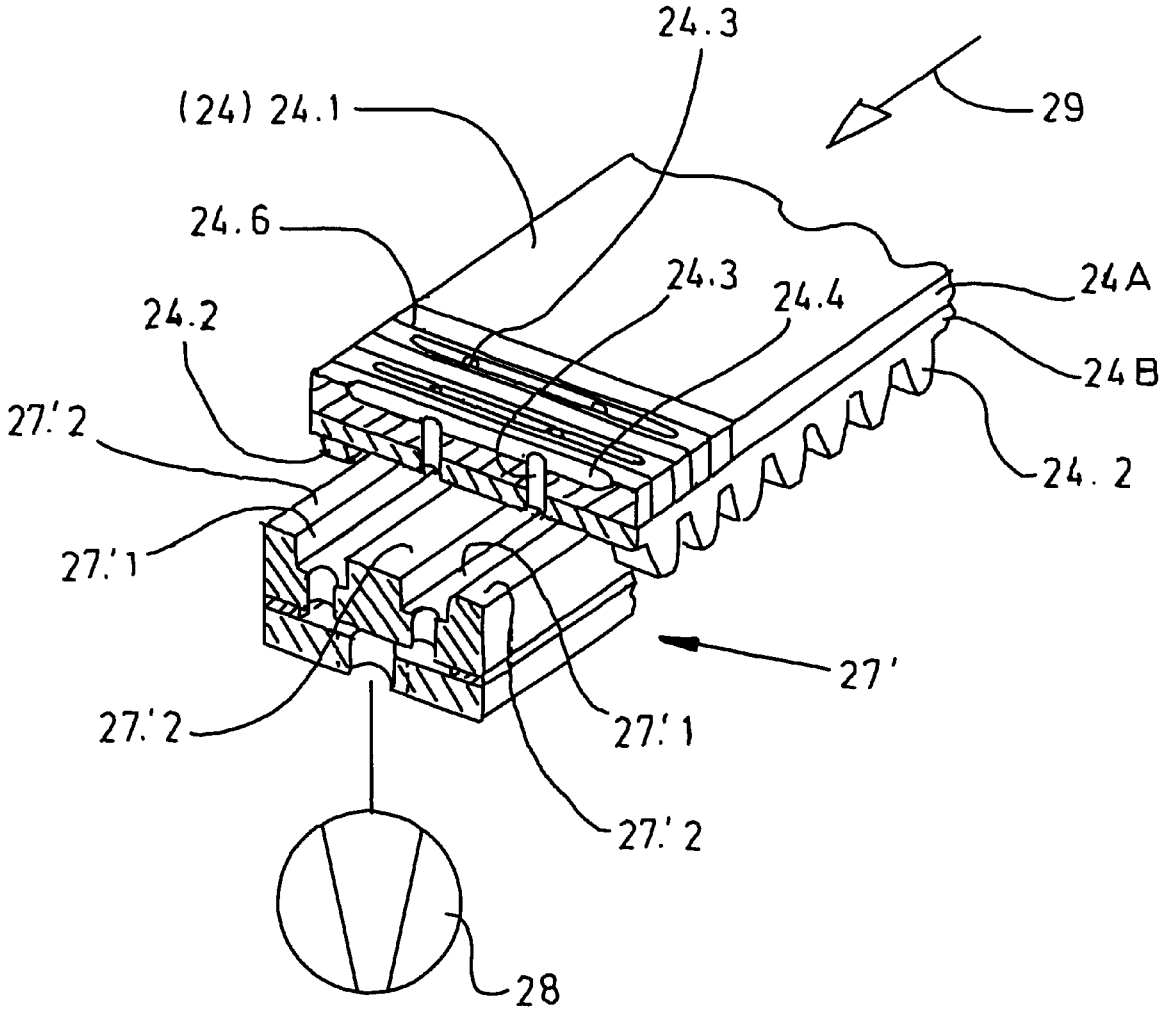
FIG. 3 is a fragmentary perspective view, partly in section of a transport strand or side of a suction belt gliding over a support, the suction belt strand having an outside structure differing from that of the suction belt shown in FIG. 2.

FIG. 3 illustrates further details for generating a holding force between one of the sheets 3 and the conveyor strand 24.1 of the suction belt 24. For generating the holding force to a support 27' adapted to the construction of the suction belt 24, a support surface 27'1 is formed. This support surface is provided with suction openings 27'1, extends straight and transversely to the conveyor direction represented by the arrow 29, and is attached to the inner side of the conveyor strand 24.1. Each of the suction openings 27'.1, respectively, is connected to a respective row of borings 24.3 arranged along and penetrating the suction belt. The borings 24.3 terminate in depressions or indentations 24.4 forming a filigree structure at the outer side of the suction belt 24.

In the embodiment illustrated in FIG. 3, the indentations 24.4 are grooves 24.4 running crosswise over the suction belt 24 and extending between the side rims or borders of the suction belt so that the grooves 24.4 are sealed from the surroundings when a sheet 3 is placed on the outside of the conveyor strand 24.1 covering the grooves due to the negative pressure or vacuum generated by the negative pressure or vacuum generator 28.

The grooves 24.4 are narrow and follow one another at slight distances, so that a filigree structure results. The nonindented areas of the outer side of the suction belt 24 form a multitude of support locations for a sheet 3, and the grooves 24.4 covered by the sheet 3 form together a large suction area. This results in a correspondingly strong normal force between the sheet 3 and the conveyor strand 24.1, while there are only very small interruptions of the support area supporting the sheet 3. The construction of a filigree structure by the aforementioned grooves 24.4 applies only to one of several possible embodiments.

Figure 4:
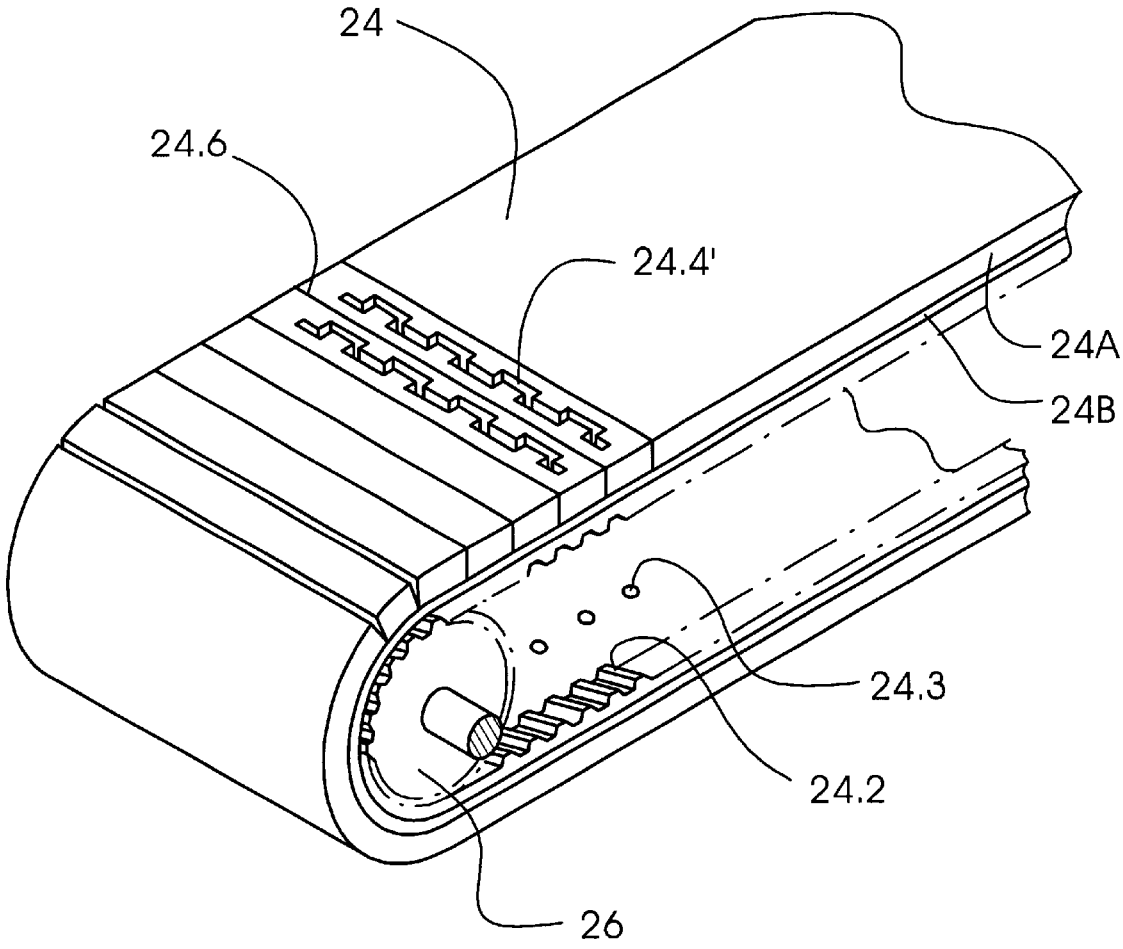
FIG. 4 is a fragmentary perspective view of an embodiment of a formlockingly drivable suction belt of the suction conveyor according to FIG. 2, it being noted, in this regard, that a formlocking connection is one which connects two elements together due to the shape of the elements themselves, as opposed to a forcelocking connection, which locks the elements together by force external to the elements.

FIG. 4 shows a similar structure of the outside of the suction belt 24 as in FIG. 3 because indentations 24.4' in the form of grooves are provided. Different from those of FIG. 3, the grooves 24.4' in this case do not extend straight and crosswise or transversely to the suction belt 24, but rather, follow a meandering course. Otherwise, the grooves 24.4' are also narrow and follow one another closely so that again a filigree structure results. At least one bore 24.3 penetrates the suction belt 24 terminates in a respective one of the meandering grooves 24.4'.

The construction of the indentations 24.4' in the form of meandering grooves can also extend across the length of the suction belt as opposed to the course of the indentations in FIG. 4.

Figure 5:
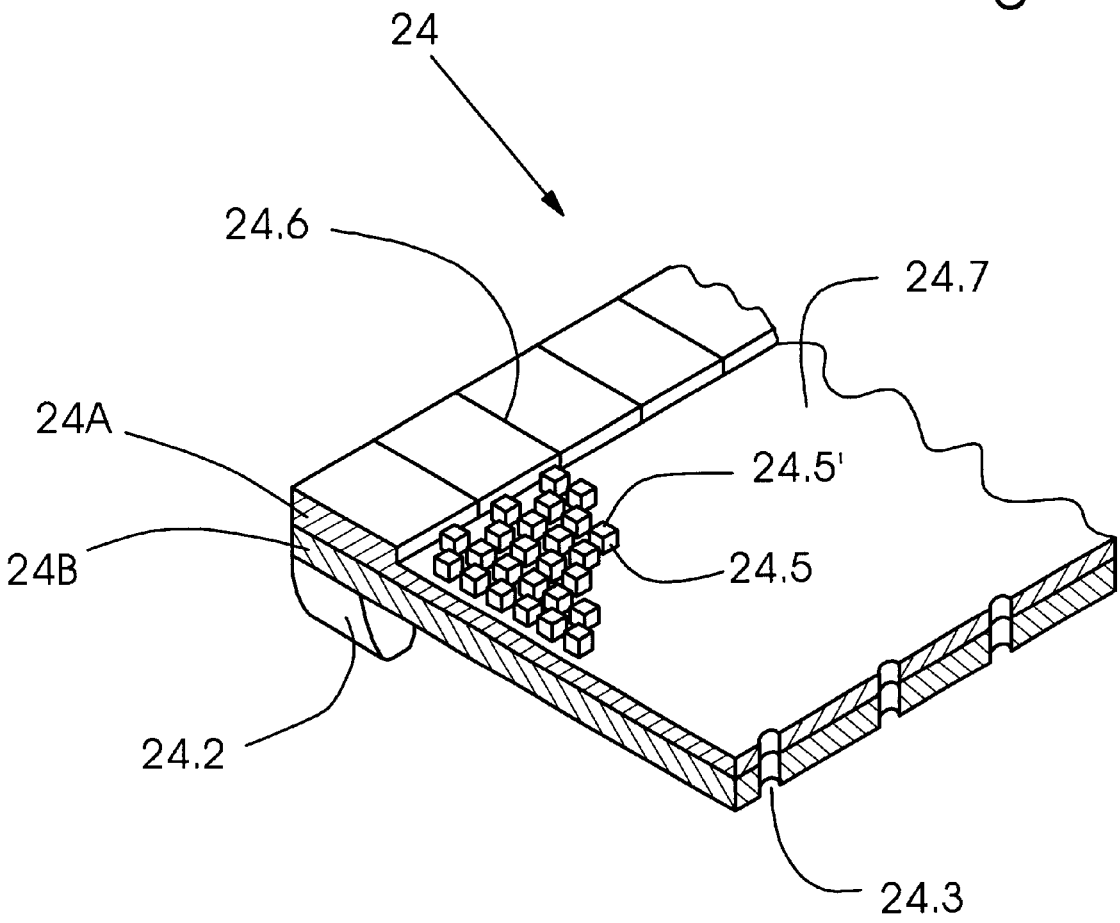
FIG. 5 is a view similar to that of FIG. 3 showing a further embodiment of the suction belt having a different filigree structure on the outside thereof.

FIG. 5 shows another variation in the filigree structure at the outside of the suction belt 24. The structure has discrete sheet supports 24.5 distributed over the length and width of the suction belt 24. These supports 24.5 are elevated across the sunken outer surface 24.7 of the suction belt 24 and form discrete sheet supports 24.5 equidistant from the inside and outside of the suction belt 24. The indentations provided for forming the filigree structure merge and form in their totality the sunken outer surface 24.7 of the suction belt 24. The bores 24.3 thus terminate in the sunken outer surface 24.7.

The extent of the sheet support surfaces 24.5 in the longitudinal and transverse directions of the suction belt 24 is smaller by a multiple than the width of the suction belt 24, and the sheet support surfaces 24.5 are arranged in distances that are also smaller by a multiple than the width of the suction belt 24. This again results in a filigree structure with a large total support area supporting the sheet 3, with an equally large total suction area communicating with the borings 24.3 penetrating the suction belt 24, the borings 24.3 terminating in the sunken outer surface 24.7 of the suction belt 24.

FIG. 5 shows an embodiment of the sheet supports 24.5 in square form, and having lateral surfaces aligned in the longitudinal direction of the suction belt 24, however, neither this form nor this direction is required. Alternatives thereto are sheet supports in the form of cones or pyramids with the base surfaces thereof touching one another in the sunken outer surface 24.4"(note FIG. 7*a*), and being only slightly larger than the top surfaces thereof. What is essential for all conceivable alternatives is only a large share of carrying surface for a large share of suction surface and an agglomeration of these shares as tightly as possible.

The filigree structure of the outer side of the suction belt 24 shown in the exemplary embodiments fosters not only the generation of high normal forces that the filigree structure and a respective sheet 3 sucked to the suction belt by the effect of the negative pressure or vacuum in the indentations 24.4, 24.4', 24.4", but also a careful support of sheet 3 so as to prevent the formation of markings thereon.

The suction belt 24 includes preferably an outer layer 24A and an inner layer 24B, as illustrated in FIGS. 2 to 5. In this regard, the properties or characteristics of the material are selected so that the outer side of the conveyor strand 24.1 exerts a higher friction force on the transported sheet under a given normal force effective at the conveyor strand 24.1, than the inner side of the conveyor strand 24.1 exerts on the support 27 and 27', respectively.

For practical reasons, the outer layer 24A can be made of polyurethane with a hardness of approximately 80 shore, and the inner layer 24B of polyurethane with a hardness of approximately 80 shore.

For a formlocking drive of the suction belt 24 through the intermediate of the teeth 24.2, the latter can be integral with the inner layer 24B.

The aforediscussed filigree structure of the suction belt 24 is preferably limited to the area located between the side border or marginal areas thereof so that lateral suction of air over the aforediscussed borings 24.3 is prevented.

The construction of the suction belt 24 of individual layers fosters the structured design and the appropriate material selection with attention to the friction behavior, but it also leads to a superelevation of the highest cross-section areas which would not be necessary for the required tensile strength or tear resistance. On the other hand, it can lead to internal tensions which would adversely affect the desired work performance and the longevity of the suction belt.

FIGS. 2 to 5 show another preferred embodiment in this context which reduces the interior tensions. In this embodiment, even parting lines 24.6 are provided which extend crosswise to the length of the suction belt 24 in the stretched areas of the suction belt 24. These parting lines 24.6 start at the outer edge of the suction belt 24 and extend in the direction to the inner edge of the suction belt 24. The parting lines 24.6 are formed so that they are closed in the stretched sections of the suction belt 24. This does not mean that the planes contacting within individual parting lines 24.6 must be even. It is only essential that the parting lines 24.6 divide the suction belt 24 into segments in the longitudinal direction thereof in the area towards the inner side of the suction belt 24 in the stretched state. These parting lines affect or influence one another only in the inner ends of the parting lines 24.6 due to the existing tensions. The segments, i.e., the mutual distances or spacings of the parting lines 24.6, are selected preferably to be so short that clearly reduced tensions result in each segment when it passes a reversing device, such as the drive wheel 25 and the reversing wheel 26, in comparison with otherwise increasing tensions.

An advantageous embodiment preferably provides that the parting lines 24.6 extend up to the inner layer 24B of the suction belt 24. In a correspondingly thinner and adequately tension resistant construction of the inner layer 24B, tensions result in the suction belt 24 which largely correspond with those of traditional suction belts with a single layer.

FIG. 6 shows an embodiment wherein only tensile stress is needed for a full contact of the suction belt 24 on the support 27 and 27', respectively. That tensile stress may be smaller than in traditional suction belts.

In the embodiment illustrated in FIG. 6, the suction belt 24, in the condition as supplied, has a cross section arched towards the inside, i.e., the longitudinal stretch of the inner side and the outer side of the suction belt 24 is smaller along the length thereof than along the marginal edges thereof. The complete contact with a support 27 and 27', respectively, of the conveyor strand 24.1 attained in this manner occurs under a local stretch of the suction belt 24 decreasing at the side thereof from the center. FIG. 5 also shows a variation with respect to the tight agglomeration of the large sheet support surface shares and the large suction area shares where the suction belt 24 is air permeable due to pores 30 that are distributed in longitudinal and transverse directions on the suction belt 24. The pores 30 are arranged closely to one another.

Such air permeable construction of the suction belt 24 is, in contrast with FIG. 6, not limited to a suction belt formed only of one layer. A suction belt formed of several layers especially with the features noted hereinabove and with the realized friction forces is constructed in preferable embodiments with air permeable pores 30 and parting lines or seams 24.6 discussed hereinabove. In a suction belt embodiment with one or more layers, the pores 30 function as capillary-like breaks in the otherwise full cross section of the suction belt 24. A variation is a suction belt construction in the form of a textile fabric structure wherein holes in the mesh function as pores.

In an authorized application of the suction belt in conjunction with the supports 27 and 27', respectively, shown in FIG. 2 or 3 for the conveyor strand 24.1 gliding thereover, the negative pressure or vacuum in the suction openings 27.1 and 27'.1, respectively, of the supports 27 and 27', respectively spreads beyond the side limits of the suction openings 27.1 and 27'.1, respectively, due to the surface mesh microstructure of the suction belt, without any special provisions. In this manner, all of the pores in the form of holes in the mesh of the suction belt guided over the supports 27 and 27', respectively, communicate with the suction openings 27.1 and 27'.1, respectively, so that a large sheet support share and a large suction surface share with a tight interlacing or agglomeration of these two surface shares are effective on the sheet 3.

FIG. 7 shows a preferred advance in the art by also allowing the use of the supports 27 and 27', respectively, as shown in FIGS. 2 and 3, when the pores 30 in the form of capillary-like breaks are provided in an otherwise complete cross section of the suction belt 24. According to this embodiment, as illustrated in FIG. 7*a,* the surface of the inner side of the suction belt 24 is formed with indentations 24.41" which connect the pores 30 crosswise in the suction belt 24. In this manner, the effect of the negative pressure or vacuum in the suction openings 27.1 and 271'.1, respectively, spreads beyond the lateral limits so that the suction openings 27.1 and 27'.1, respectively, also communicate with the lateral pores 30.

Figure 8:
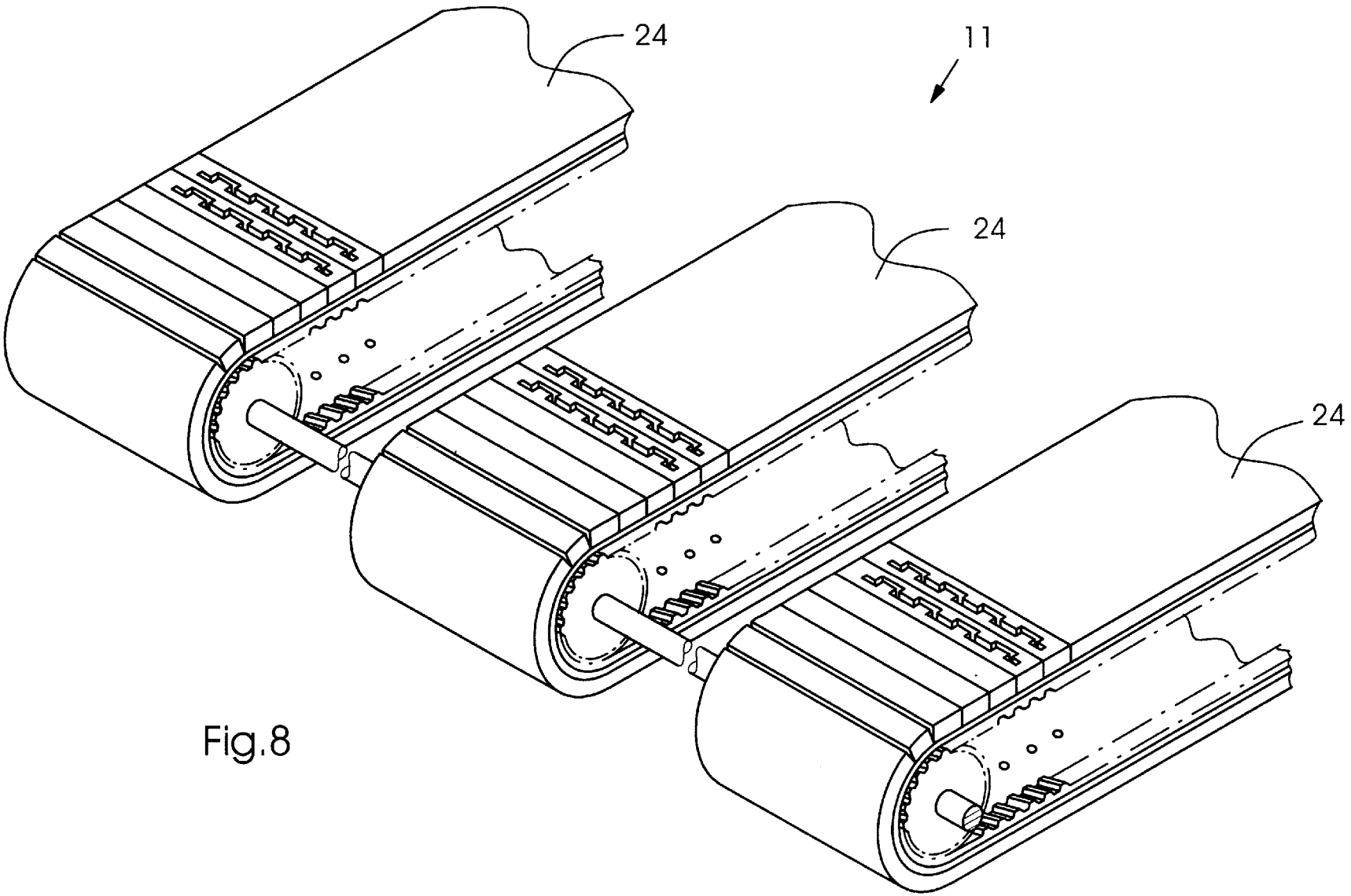
FIG. 8 is a fragmentary perspective of a sheet brake formed by a plurality of revolving suction belts.

FIG. 8 shows a fragmentary perspective at a sheet brake 11 formed by a plurality of revolving suction belts 24.

We claim:

1. A suction belt conveyor for a sheet processing machine, comprising:

an operationally revolving endless suction belt having, at an outer side thereof a filigree structure formed by indentations, said suction belt being formed with penetrating bores terminating in said indentations;

said suction belt including an outer layer and an inner layer; and said suction belt formed with parting lines extending substantially crosswise to the longitudinal direction of the suction belt starting from the outer side thereof, said parting lines extending in a direction towards the inner side of the suction belt.

2. A suction belt conveyor for a sheet processing machine, comprising:

an operationally revolving endless suction belt formed with pores distributed in longitudinal and transverse directions of said suction belt, so that said suction belt is air permeable;

said suction belt including an outer layer and an inner layer; and said suction belt formed with parting lines extending substantially crosswise to the longitudinal direction of the suction belt starting from the outer side thereof, said parting lines extending in a direction towards the inner side of the suction belt.

3. The suction belt conveyor according to claim 1, wherein said suction belt has a transport strand and is operationally slidable by an inner side of said transport strand along a support, said transport strand having an outer side for exerting a higher friction force on a transported sheet than said inner side of said transport strand exerts upon said support when a given normal force acts upon said transport strand.

4. The suction belt conveyor according to claim 2, wherein said suction belt has a transport strand and is operationally slidable by an inner side of said transport strand along a support, said transport strand having an outer side for exerting a higher friction force on a transported sheet than said inner side of said transport strand exerts upon said support when a given normal force acts upon said transport strand.

5. The suction belt conveyor according to claim 1, including a drive wheel, said suction belt having a formlocking connection with said drive wheel at least at one edge of said suction belt.

6. The suction belt conveyor according to claim 2, including a drive wheel, said suction belt having a formlocking connection with said drive wheel at least at one edge of said suction belt.

7. The suction belt conveyor according to claim 1, wherein said suction belt, in supplied condition thereof, has a cross section extending in such a manner that an inner side and said outer side of said suction belt have a smaller extension along the longitudinal center thereof than at the edges thereof.

8. The suction belt conveyor according to claim 2, wherein said suction belt, in supplied condition thereof, has a cross section extending in such a manner that an inner side and said outer side of said suction belt have a smaller extension along the longitudinal center thereof than at the edges thereof.

9. A delivery of a sheet processing machine, comprising a sheet brake formed by a plurality of suction belt conveyors according to claim 1.

10. A delivery of a sheet processing machine, comprising a sheet brake formed by a plurality of suction belt conveyors according to claim 2.

11. The suction belt conveyor according to claim 1, wherein the sheet processing machine is a printing machine.

12. The suction belt conveyor according to claim 2, wherein the sheet processing machine is a printing machine.

* * * * *